US006246144B1

(12) United States Patent
Hockaday et al.

(10) Patent No.: US 6,246,144 B1
(45) **Date of Patent: *Jun. 12, 2001**

(54) CARBON BRUSH HOLDERS OR CARDS

(75) Inventors: Shepard L. Hockaday, Benson; Beecher G. Simmons, Four Oaks; Scott L. Fitzner, Dunn; Michael W. Nedriga, Raleigh, all of NC (US)

(73) Assignee: Morganite Incorporated, Dunn, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/120,104

(22) Filed: Jul. 21, 1998

(51) Int. Cl.[7] ..... H01R 39/38; H01R 39/40; H01R 39/36

(52) U.S. Cl. ..... 310/242; 310/247; 310/249

(58) Field of Search ..... 310/239, 249, 310/242, 244, 247; 439/346

(56) References Cited

U.S. PATENT DOCUMENTS 3,842,302 * 10/1974 Apostoleris ..... 310/239
3,967,148 * 6/1976 Walsh ..... 310/239
4,297,605 * 10/1981 Tak ..... 310/242
5,621,262 4/1997 Han ..... 310/239
5,686,775 11/1997 Veil et al. ..... 310/239

FOREIGN PATENT DOCUMENTS 78 05 597 6/1978 (DE) .
1238113 11/1960 (FR) .

OTHER PUBLICATIONS

International Search Report for International Application No. PCT/US99/14548.

* cited by examiner

*Primary Examiner*—Nestor Ramirez
*Assistant Examiner*—Dang Dinh Le
(74) *Attorney, Agent, or Firm*—Dean W. Russell; Kilpatrick Stockton LLP

(57) ABSTRACT

Brush card or holder assemblies are disclosed. The assemblies avoid any need for a separate plastic cap and utilize a lead wire (which could be or include a rod or other electrically-conductive device) both electrically to connect a brush to an external component and mechanically to fix the position of one end of a mechanism, such as a spring, for biasing the brush toward the surface of a commutator or other rotating machine element.

20 Claims, 1 Drawing Sheet

CARBON BRUSH HOLDERS OR CARDS

FIELD OF THE INVENTION

This invention relates to assemblies including holders, or cards, for devices typically called carbon brushes and more particularly to holders for such brushes in which a lead functions not only to carry electricity to or from a brush but also to compress a spring or other mechanism used to bias the brush toward a rotating mechanism such as a commutator.

BACKGROUND OF THE INVENTION

U.S. Pat. No. 5,621,262 to Han, incorporated herein in its entirety by this reference, illustrates in its FIGS. 1 and 2 exemplary existing carbon brush holders. Both holders include (unlettered) caps, typically formed of plastic like material B of FIG. 1. Additionally shown in FIG. 2 are a brush C to which a lead is attached or embedded, with the lead in turn being connected to terminal G. An (unlettered) spring biases brush C (downward in the drawing) toward the surface of a rotating commutator, with the cap of the holder serving to compress the spring and effectively fix the position of one of its ends.

Also disclosed in the Han patent are various embodiments of a brush holder in which a flexible copper lead connects a brush to an element denoted a "brush terminal," which brush terminal in turn contacts an element called the "lead terminal." Like the brush holder of FIG. 2 of the Han patent, these other embodiments may contain a spring useful to bias the brush to contact the surface of a commutator. As illustrated in FIG. 15 of the Han patent, for example, the position of one end of the spring (the upper end shown in the drawing) is fixed by the brush terminal and underside of a cap screwed into the holder body, while its other end abuts a carbon brush. According to the Han patent, the cap is plastic and functions also to press together the lead and brush terminals.

Other commercially-available designs involving torsion springs include seventeen components, while those utilizing leaf and coil springs may contain as many as thirteen components. Typical coil-spring designs, for example, require not only a card and dual shunted brushes, but also two brush boxes, two coil springs, two lead wires, and four terminals (two to the brush boxes and two to external switches). Assembly of these coil-spring designs requires two repetitions of eight steps, including (1) inserting a spring into a brush box, (2) inserting a brush into the brush box, (3) bonding the shunt wire to the brush box, (4) bending the tab of the brush box to retain the brush and spring within the box, (5) bonding one end of a lead wire to a terminal (to the brush box), (6) bonding the other end of the lead wire to a terminal (to an external switch), (7) mounting the brush box assembly to a brush card, and (8) inserting a lead wire and terminal into a terminal of the brush box. Although assembly of existing leaf-spring designs necessitates two repetitions of fewer steps (six rather than eight), it nonetheless continues to require steps of bonding of lead wires and leaf springs to terminals or mounts and interconnecting the components via the terminals.

SUMMARY OF THE INVENTION

The present invention, by contrast, encompasses assemblies of brush cards or holders containing as few as nine components in some dual-brush embodiments and whose assembly is less complex than those techniques described in the preceding section. It additionally avoids any need to use a separate plastic cap such as that of the brush holders of the Han patent. Instead, a single lead wire (which could be or include a rod or other electrically-conductive device) not only electrically connects the brush and an external switch but also mechanically fixes the position of one end of a biasing mechanism such as a spring. By utilizing a lead wire with sufficient rigidity to withstand the expansive force of the spring without significant deformation and securing its position vis-a-vis the abutting end of the spring, the cards of the present invention provide simpler devices for holding functional carbon brushes.

Certain embodiments of the present invention contemplate placement of two conductive blocks such as brushes in a card or holder, each designed to contact the same rotating object (e.g. a commutator) in use. However, to complete an electrical connection between the commutator and an external device (such as but not limited to a switch), only a single block or brush is necessary. Thus, for a shunted brush, only a card, biasing means, and a lead wire are necessary to convey electricity reliably from the commutator to an external device (or vice-versa). Typically one end of the lead wire is connected to the shunt, while the other connects directly or indirectly (through, e.g., a terminal) to the external device.

In addition to being connected to the shunt, the lead wire of the present invention may also be secured to the brush card itself. Embodiments of the invention are designed for the lead wire to be the subject of an interference fit with a slot in the card. However, those skilled in the art will recognize that other means (including adhesive as one of multiple examples) may be employed to retain the lead wire in position respecting the brush card.

Assuming the biasing means is a coil spring, one end of the spring abuts the end of the brush opposite the commutator to allow the spring force to press against the commutator surface. The other end of the spring directly (or indirectly if appropriate) abuts the lead wire, typically in an insulated area of the wire. Because the lead wire is selected to withstand the expansive force of the spring without significant deformation, it provides an essentially immovable base against which the spring can expand in the opposite direction.

It is therefore an object of the present invention to provide a card or holder for an electrically-conductive brush.

It is also an object of the present invention to provide a brush card assembly which is simpler to assemble and requires fewer components than analogous conventional assemblies.

It is another object of the present invention to provide a brush card assembly which does not require any plastic cap.

It is an additional object of the present invention to provide a brush card assembly in which a lead wire not only electrically connects to the brush but also mechanically fixes the position of one end of a mechanism (such as a spring) used to bias the brush against the surface of a rotating machine such as a commutator.

It is a further object of the present invention to provide an assembly in which the lead wire is sufficiently rigid to withstand the expansive force of a spring without significant deformation.

It is yet another object of the present invention to provide an assembly in which the lead wire is secured to the brush card as, for example, by an interference fit.

Other objects, features, and advantages of the present invention will be apparent with reference to the remaining text and the drawings of this application.

DETAILED DESCRIPTION

Figure 1:
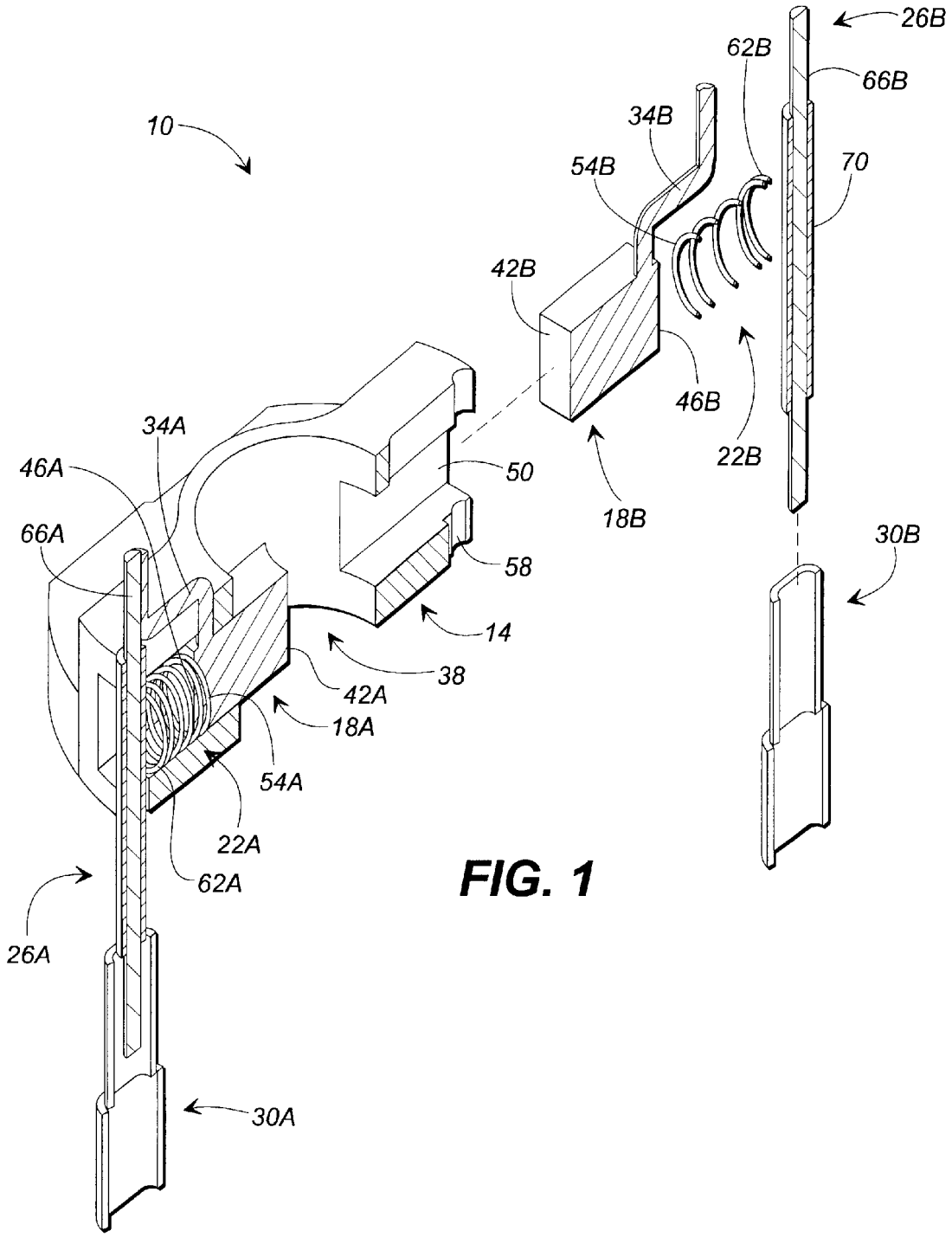
FIG. 1 is an exploded perspective view of a section of a dual-brush embodiment of a card assembly of the present invention.

Illustrated in FIG. 1 is an exemplary assembly 10 of the present invention. As shown in the sectional view of FIG. 1, assembly 10 may comprise holder or card 14, brushes 18A and 18B, coil springs 22A and 22B, and lead wires 26A and 26B. Also illustrated in FIG. 1 are terminals 30A and 30B and shunts 34A and 34B, the latter of which are embedded or otherwise electrically connected respectively to brushes 18A and 18B.

Card 14 typically defines an opening 38 designed to surround or circumscribe a commutator of an electric motor. Either or both of brushes 18A and 18B contact the surface of the commutator in use, with their edges 42A and 42B wearing over time because of, among other phenomena, the frictional contact with the commutator. Protruding typically (although not necessarily) from a face at or near the opposite edge 46A of brush 18A is shunt 34A, used to carry electricity to or from the brush 18A. Brush 18B may be similarly configured, with current-carrying shunt 34B protruding either from edge 46B of the brush 18B or from a face of the brush other than edge 42B. Because each of brushes 18A and 18B is made of electrically conductive material (carbon or graphite of low electrical resistance, for example), electrical current can flow from shunt 34A or 34B through the associated brush 18A or 18B to the commutator surface (or vice-versa).

Card 14 also defines slots, often oriented in a common plane, into which brushes 18A and 18B may be fitted. FIG. 1 illustrates brush 18A as fitted into its corresponding slot, while a portion of slot 50 for brush 18B is visible in the drawing. Additionally positioned within these slots are springs 22A and 22B, each having a respective end 54A or 54B designed to urge brush 18A or 18B against the commutator surface.

Defined as part of card 14, moreover, are a second set of slots (typically but not necessarily oriented generally perpendicularly to slots 50) into which lead wires 26A and 26B may be fitted. FIG. 1 details a portion of one of these slots 58, each of which in some embodiments receives a lead wire 26A or 26B and retains the wire in place with an interference fit. As so fitted, lead wires 26A and 26B abut respective ends 62A and 62B of springs 22A and 22B. Thus, by forming lead wires 26A and 26B of material sufficiently rigid to withstand the expansive force of their associated springs 22A and 22B without significant deformation, the wires 26A and 26B can function as relatively immobile bases (or boundaries) for the springs 22A and 22B. As a consequence, no other component, such as a plastic cap or other non-deformable part, is required to retain the springs 22A and 22B in slots 50.

Although slot 58 and an interference fit are presently preferred methods of securing lead wires 26A and 26B to card 14, those skilled in the art will recognize that other suitable methods of affixing the lead wires 26A and 26B to the card 14 may exist. As noted above, the present invention contemplates securing each of lead wires 26A and 26B in position with sufficient force to withstand (and overcome) attempted expansion of springs 22A and 22B by movement of their ends 62A and 62B. Any such securing means that provides this force, therefore, may be used when necessary or desired.

In addition to serving as bases for springs 22A and 22B, lead wires 26A and 26B function to convey electricity to or from respective brushes 18A and 18B. Uninsulated portion 66A of lead wire 26A is thus shown electrically connected to shunt 34A, while corresponding portion 66B of lead wire 26B electrically connects to shunt 34B. The electrical connections may be made directly (as, for example, by adhering or bonding the lead wires 26A and 26B into contact with respective shunts 34A and 34B) or indirectly using any appropriate means of establishing such connections.

Each of lead wires 26A and 26B typically terminates in a terminal 30A or 30B (often crimped about or bonded to the wire) for connection to an external switch or other device or component. Because shunts 34A and 34B are flexible, they can continue to connect lead wires 26A and 26B to brushes 18A and 18B, respectively, notwithstanding wear of edges 42A and 42B and movement of the brushes 18A and 18B under the force of springs 22A and 22B. Electrical communication between brushes 18A and 18B and lead wires 26A and 26B alternatively could occur through springs 22A and 22B (if such springs are made of conductive material such as uninsulated metal and insulation 70 is removed from the lead wires), although such electrical communication is not as reliable as when the shunts 34A and 34B are employed.

Although coil springs 22A and 22B are shown in FIG. 1, they are not the only means of biasing brushes 18A and 18B useable in connection with the present invention. Instead, any mechanism (for example mechanical or electrical) capable of urging brushes 18A and 18B toward opening 38 could in some cases be appropriate. Furthermore, assembly 10 need not incorporate two brushes 18A and 18B, as assemblies having only one brush 18A may be made consistent with the present invention. In such case assembly 10 would not necessarily include any of brush 18B, spring 22B, lead wire 26B, or terminal 30B, nor would one each of slots 50 and 58 associated with these components be needed. Of course, assembly 10 alternatively may include more than two brushes 18A and 18B when desired.

Building assembly 10 is straightforward. One assembly method begins by inserting brush 18A, followed by spring 22A, into card 14. Lead wire 26A is then pressed (fitted) into its corresponding slot 58 and shunt 34A is electrically connected to portion 66A of the lead wire 26A. If terminal 30A is used, it can then be crimped or bonded onto (or otherwise attached to) lead wire 26A. These steps may, of course, be repeated if brush 18B is utilized in card 14 and varied or reordered as necessary or desired.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. An assembly for conveying electricity to or from a rotating device, comprising:

a. an electrically-conductive block;

b. means for urging the electrically-conductive block into contact with the rotating device; and c. an elongated lead wire electrically communicating with the electrically-conductive block and mechanically bounding the urging means, the elongated lead wire being in the shape of a rod and having an insulated portion contacting the urging means.

2. An assembly according to claim 1 in which the electrically-conductive block comprises a brush and the rotating device comprises a commutator.

3. An assembly according to claim 1 in which the urging means comprises a spring.

4. An assembly according to claim 1 in which the elongated lead wire has sufficient rigidity to provide an essentially immobile base for the urging means.

5. An assembly according to claim 1 in which the elongated lead wire constitutes the sole means to mechanically bound the urging means.

6. An assembly for conveying electricity to or from a rotating device, comprising:

a. a holder;

b. an electrically-conductive brush positioned at least partially within the holder;

c. a coil spring having first and second ends, the first end contacting the electrically-conductive brush and urging it toward the rotating device; and d. an elongated lead wire, in the shape of a rod and having an insulated portion in contact with the second end of the coil spring, the elongated lead wire being secured to the holder and electrically communicating with the electrically-conductive brush.

7. An assembly according to claim 6 further comprising a shunt electrically connecting the elongated lead wire and electrically-conductive brush.

8. An assembly according to claim 7 in which the holder defines a slot and the elongated lead wire is secured to the holder by being fitted into the slot.

9. An assembly according to claim 8 omitting any plastic insulating cap, further comprising a terminal electrically connecting the elongated lead wire with an external device.

10. An assembly according to claim 9 in which the holder also defines a second slot, further comprising:

a. a second electrically-conductive brush positioned at least partially within the holder;

b. a second coil spring having first and second ends, the first end contacting the second electrically-conductive brush and urging it toward the rotating device; and c. a second lead wire secured to the holder by being fitted into the second slot in contact with the second end of the second coil spring and electrically communicating with the second electrically-conductive brush.

11. An assembly according to claim 6 in which the coil spring is retained in the holder solely by the elongated lead wire.

12. An assembly for conveying electricity to or from a commutator, comprising:

a. a holder defining (i) first and second slots oriented in a common plane and (ii) third and fourth slot oriented generally perpendicularly to the common plane;

b. a first carbon brush at least partially positioned within the first slot;

c. a second carbon brush at least partially positioned within the second slot;

d. a first coil spring (i) positioned within the first slot and (ii) having first and second ends, the first end of which contacts the first carbon brush and biases it toward the commutator;

e. a second coil spring (i) positioned within the second slot and (ii) having first and second ends, the first end of which contacts the second carbon brush and biases it toward the commutator;

f. a first shunt connected to the first brush;

g. a second shunt connected to the second brush;

h. a first lead wire having an insulated portion, the first lead wire being (i) fitted into the third slot with the insulated portion in contact with the second end of the first coil spring and (ii) connected to the first shunt; and i. a second lead wire (i) fitted into the fourth slot in contact with the second end of the second coil spring and (ii) connected to the second shunt.

13. An assembly according to claim 12 further comprising first and second terminals, the first terminal being connected to the first lead wire and the second terminal being connected to the second lead wire.

14. An assembly according to claim 12 in which:

a. the first coil spring is retained in the first slot solely by the first lead wire; and b. the second coil spring is retained in the second slot solely by the second lead wire.

15. A method of building an assembly for conveying electricity to or from a rotating device, comprising:

a. providing a holder;

b. inserting a brush at least partially into the holder;

c. inserting a spring into the holder in contact with the brush;

d. fitting an elongated lead wire, in the shape of a rod and having an insulated portion, into a slot defined by the holder so the insulated portion contacts the spring, the elongated lead wire having sufficient rigidity to withstand the expansive force of the spring without significant deformation; and e. electrically connecting the elongated lead wire to the brush.

16. A method according to claim 15 further comprising repeating steps b.–e. for a second brush, a second spring, and a second elongated lead wire.

17. A method according to claim 15 further comprising electrically connecting the elongated lead wire to a terminal.

18. An assembly for conveying electricity to or from a rotating device, comprising:

a. an electrically-conductive block;

b. means for urging the electrically-conductive block into contact with the rotating device; and c. an elongated lead wire in the shape of a rod electrically communicating with the electrically-conductive block and having an insulated portion mechanically bounding the urging means.

19. An assembly for conveying electricity to or from a rotating device, comprising:

a. an electrically-conductive block;

b. means for urging the electrically-conductive block into contact with the rotating device; and c. a lead wire in the shape of a straight, continuous elongated rod electrically communicating with the electrically-conductive block and mechanically bounding the urging means.

20. An assembly according to claim 19 in which the lead wire constitutes the sole means to mechanically bound the urging means.

* * * * *